US010575590B2

(12) United States Patent
Rankin

(10) Patent No.: US 10,575,590 B2
(45) Date of Patent: Mar. 3, 2020

(54) NO BOW LACE LOOPERS

(71) Applicant: James Rankin, Las Vegas, NV (US)

(72) Inventor: James Rankin, Las Vegas, NV (US)

( * ) Notice: Subject to any disclaimer, the term of this patent is extended or adjusted under 35 U.S.C. 154(b) by 106 days.

(21) Appl. No.: 15/333,608

(22) Filed: Oct. 25, 2016

(65) Prior Publication Data

US 2018/0110297 A1 Apr. 26, 2018

(51) Int. Cl.

| | |
|---|---|
| ***A43C 7/00*** | (2006.01) |
| ***A43C 11/00*** | (2006.01) |
| ***A43C 11/14*** | (2006.01) |
| ***A43C 11/24*** | (2006.01) |

(52) U.S. Cl.

CPC ..... *A43C 7/00* (2013.01); *A43C 11/008* (2013.01); *A43C 11/1406* (2013.01); *A43C 11/24* (2013.01)

(58) Field of Classification Search

CPC ..... A43C 7/00; A43C 11/008; A43C 11/1406; A43C 11/24; F21V 23/0414; F21Y 2115/10

USPC ..... 36/50.1

See application file for complete search history.

(56) References Cited

U.S. PATENT DOCUMENTS

| | | | | | |
|---|---|---|---|---|---|
| 230,759 | A * | 8/1880 | Drummond | A43C 11/16 | 24/68 SK |
| 1,090,438 | A * | 3/1914 | Worth | B60R 22/38 | 24/712.1 |
| 4,719,670 | A * | 1/1988 | Kurt | A43C 11/16 | 24/68 SK |
| 5,157,813 | A * | 10/1992 | Carroll | A43C 7/00 | 24/68 B |
| 7,076,843 | B2 * | 7/2006 | Sakabayashi | A43C 7/00 | 24/68 SK |
| 7,367,522 | B2 * | 5/2008 | Chen | A43C 7/00 | 24/68 SK |
| 7,950,112 | B2 * | 5/2011 | Hammerslag | A43B 5/16 | 24/68 SK |
| 7,954,204 | B2 * | 6/2011 | Hammerslag | A43B 5/16 | 24/68 SK |
| 8,245,371 | B2 * | 8/2012 | Chen | A43C 7/00 | 24/68 B |
| 8,353,087 | B2 * | 1/2013 | Chen | A43C 11/165 | 24/68 SK |
| 9,408,438 | B2 * | 8/2016 | Chen | A43C 11/165 | |
| 9,681,705 | B2 * | 6/2017 | Trudel | A43C 7/00 | |
| 9,743,715 | B1 * | 8/2017 | Brekke-Jones | A43C 19/00 | |
| 2002/0178548 | A1 * | 12/2002 | Freed | A43C 11/08 | 24/19 |
| 2005/0247813 | A1 * | 11/2005 | Kovacevich | A42B 3/08 | 242/388.6 |
| 2008/0141560 | A1 * | 6/2008 | Lewis | A43B 3/0078 | 36/50.1 |
| 2017/0099913 | A1 * | 4/2017 | Beers | A43C 11/165 | |
| 2017/0143077 | A1 * | 5/2017 | West | A43C 11/008 | |

* cited by examiner

*Primary Examiner* — Anne M Kozak

(74) *Attorney, Agent, or Firm* — Weiss & Moy, P.C.; Jeffrey D. Moy

(57) ABSTRACT

A shoe lace securement mechanism including a spool, a threading and locking mechanism, a cap, and an ornamental casing. The mechanism is designed to maintain shoe lace tension without the need for a bow or knot and modularly applicable to a wide variety of footware.

2 Claims, 3 Drawing Sheets

NO BOW LACE LOOPERS

CROSS-REFERENCE TO RELATED APPLICATIONS

Ser. No. 16/62,493,012

FEDERALLY SPONSORED RESEARCH

None

SEQUENCE LISTING

None

TECHNICAL FIELD OF INVENTION (FOI)

The present invention is generally directed to the field of shoe lace securement mechanisms and in particular to a device and process whereby shoe laces can be easily secured by an operator or user to provide consistent shoe lace tension and reduce the chances of losing lace tension as well as combine an ornamental feature highly desired in contemporary footwear. The present invention contemplates a spool, a threading piece with locking mechanism, and a cap piece.

BACKGROUND

The present invention relates to shoe lace securement mechanisms that can be customized for a desired ornamental effect.

Most conventional shoes are formed with a plurality of reinforced apertures which extend longitudinally on both sides of the center of the upper from the vamp up to the ankle of the shoe. The apertures are located on the facing edges of the shoe upper directly over the tongue of the shoe. A shoelace is then laced through the apertures. The free ends of the shoelace are typically encased within small, rigid, cylindrical plastic tips which facilitate insertion of the shoelace ends through the apertures. The ends of the shoelace are first passed through the apertures adjacent to the vamp and are progressively and sequentially passed through the plurality of apertures, crossing over the tongue each time from one aperture to the next from the vamp of the shoe up to the ankle. Once the free ends of the shoelace have been threaded through the uppermost eyelets at the ankle of the shoe they are normally tied together in the form of a knot or bow.

Traditional tie up shoe lace cords can be difficult to manually tie effectively, consistently and quickly. This is constraining for either children who have not learnt to tie traditional laces into bows/knots or for people with physical handicaps, arthritis or disabilities. Furthermore, lace bows/loops being positioned on the outside of the shoe can come undone or catch on something potentially causing the wearer to trip. Additionally, the bow/knots are aesthetically unappealing and especially when tied unevenly.

Previous devices are deficient from the point of view of a consumer with a desire to quickly, easily, and simply maintain adequate tension while securing shoe laces. Further, some current devices require a combination of mechanics to increase the tension, greatly increasing the production cost of a shoe. The present invention is based off an easily produced and simple design capable of being configured as a removable shoe accessory or incorporated into the design of a shoe.

Some examples of the variety of devices which secure or tighten shoe laces or the like can be summarized in the following. One type of machine, shown in U.S. Pat. No. 5,157,813, uses a crank driven device affixed to the tongue of a shoe to increase the tension of the laces through rotation. Laces are fed through the rotation device which is turned to increase tension. A spring operates to prevent the tension from becoming too high and causing discomfort. This prior art is a good example of a tightening mechanism, but this device is mechanically complex, difficult to produce, and aesthetically unappealing.

Other machines provide motor powered tightening. For instance, U.S. Pat. No. 7,752,774 is an automatic shoe lace tightening system. This machine is meant to be operated via a switch with a motor and spool whereby the laced wrap around the spool and increase lace tension for the user. Clearly, this machine is an expensive product that must be integrated within the shoe, preventing interchangeability between commonly available shoes and increasing maintenance costs. In contrast, the present invention can be manufactured with extremely low cost and can be placed in any shoe with laces at the consumer level or, alternatively, directly incorporated into the manufacturer's design.

Accordingly, it would be advantageous to provide a device that is designed as an inexpensive and interchangeable customer installed shoe lace securement mechanism which maintains shoe lace tension, does not require production level integration or expensive mechanical parts, is operable by persons unable to tie a knot, and maintains or increases aesthetic appeal.

As such, the present invention considers the shoe lace securement mechanisms of the past but improves on their goals by integrating the features of the present invention. No other device provides for lace securement without mechanical means that is easily manufactured, easily installed by a consumer in any conventional laced shoe, and maintains the aesthetic appeal of the shoe.

SUMMARY

The present invention is generally directed to the field of shoe lace securement mechanisms and in particular to a device and process whereby shoe laces can be easily secured by an operator or user to provide consistent shoe lace tension and reduce the chances of losing lace tension as well as combine an ornamental feature highly desired in contemporary footwear. In an embodiment, the invention contemplates four pieces: a spool, a threading piece with locking mechanism, a cap piece, and an ornamental casing.

A spool is comprised of two disc-shaped edges connected via a centrally located hollow tube. A hollow tube is configured to accept a central protrusion from the threading piece with locking mechanism. A plurality of radially located protrusions are interspersed equidistantly on the inward facing walls of each disc shaped edge surface. Each protrusion is aligned with its sister protrusion on the opposing inward facing wall of the disc shaped edges but leaves sufficient space to permit a shoe lace to penetrate to the hollow central tube. The outward facing disc-shaped edge contains a circular depression and two vertical protrusions in the center where the hollow tube emerges.

A threading piece with locking mechanism is comprised of a disc shaped piece and a solid protrusion extending perpendicular to the disc shaped piece. A solid protrusion is configured to traverse the hollow tube of the spool. A distal end of the protrusion provides for a locking mechanism whereby the protrusion is shaped as a rectangle. Once a distal end of a protrusion emerged from a centrally located hollow tube of the spool, it can be rotated approximately ninety degrees to prevent the protrusion from slipping back through the hollow tube.

A cap piece is comprised of an ovular shaped piece with crescent indentations which is to be placed on top of a distal end of the protrusion when it has traversed the hollow tube of a spool. A centrally located male insertion piece rises from the inward facing wall of the cap piece that fits into a female receptor of the distal end of the protrusion. Once mated, any torque applied to the threading piece will be transferred to the cap piece which prevents rotation by contact with two vertical protrusions on the outward facing disc-shaped circular depression. A cap piece will be secured to the spool via a flexible material that will run from the outer facing wall of the disc shaped edge closest to the shoe.

An ornamental casing will be affixed to the outer facing wall of a spool with a central depression to permit a cap piece to mate with a distal end of a protrusion. An ornamental casing will be comprised of a translucent plastic and will contain a plurality of light-emitting diodes ("LED") and a power source. A plurality of LEDs can be variably configured to illuminate a logo, character, number, symbol, or image affixed to the surface of the ornamental casing as required. Additionally or alternatively, a plurality of LEDs can be illuminated in different colors or at varying intervals. The LEDs can be activated by a switch or other common activation method located on the ornamental casing.

A present and primary embodiment envisions usage by placing the threading piece with locking mechanism on the inside of a shoe at the highest located aperture. A spool is placed on the opposing side of the same aperture. A threading piece is fed through an aperture and a spool. A threading piece is then rotated ninety degrees. A cap piece is then placed on a distal end of a protrusion. The same process is repeated on the opposite side of the shoe with a second device.

A user will then manually tighten shoe laces to the desired tension level. At the desired tension level, a user will align a shoe lace with a spool and begin to wrap the shoe laces around a spool. The surface friction of the laces on the spool will prevent any loss of tension. Additionally, radially dispersed protrusions on the inner facing walls of a spool will add additional friction by keeping the shoe lace compressed around the spool.

This summary is not intended to identify key features or essential features of the claimed subject matter, nor is it intended to be used as an aid in determining the scope of the claimed subject matter. Additional features and advantages of exemplary implementations of the present disclosure will be set forth below, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF DRAWINGS

An embodiment of the present invention will hereinafter be described in conjunction with the appended drawings, provided to illustrate and not to limit the invention, in which.

DETAILED DESCRIPTION OF DRAWINGS

Figure 1:
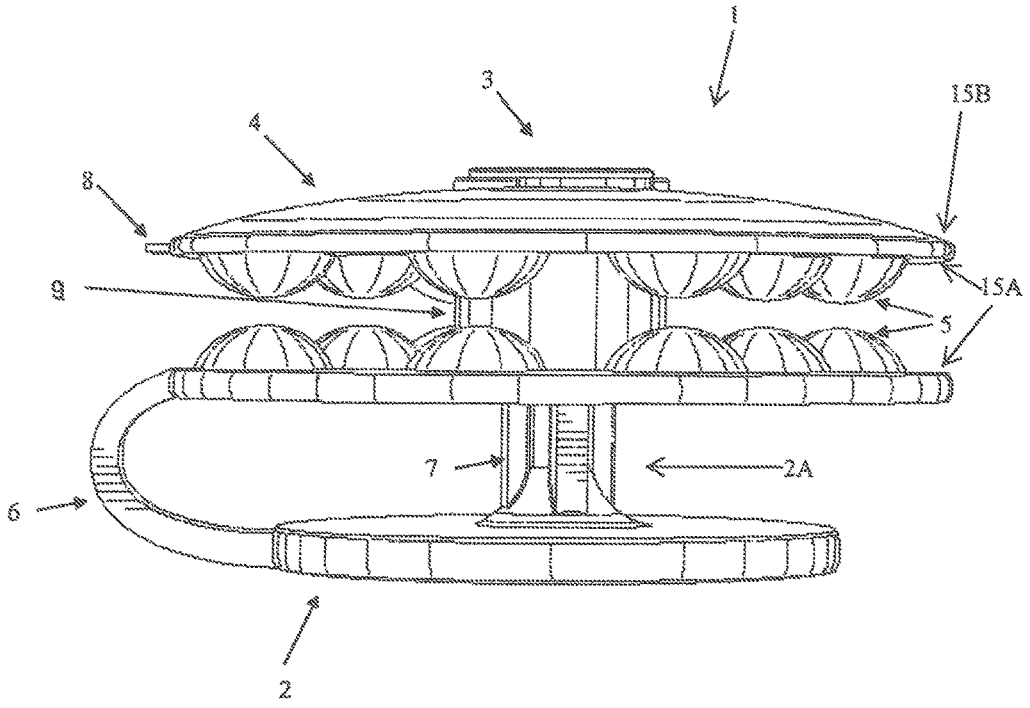
FIG. 1: is a side perspective view of the shoe lace securement mechanism with the spool, the threading piece with locking mechanism, the cap piece, and an ornamental casing.
Figure 2:
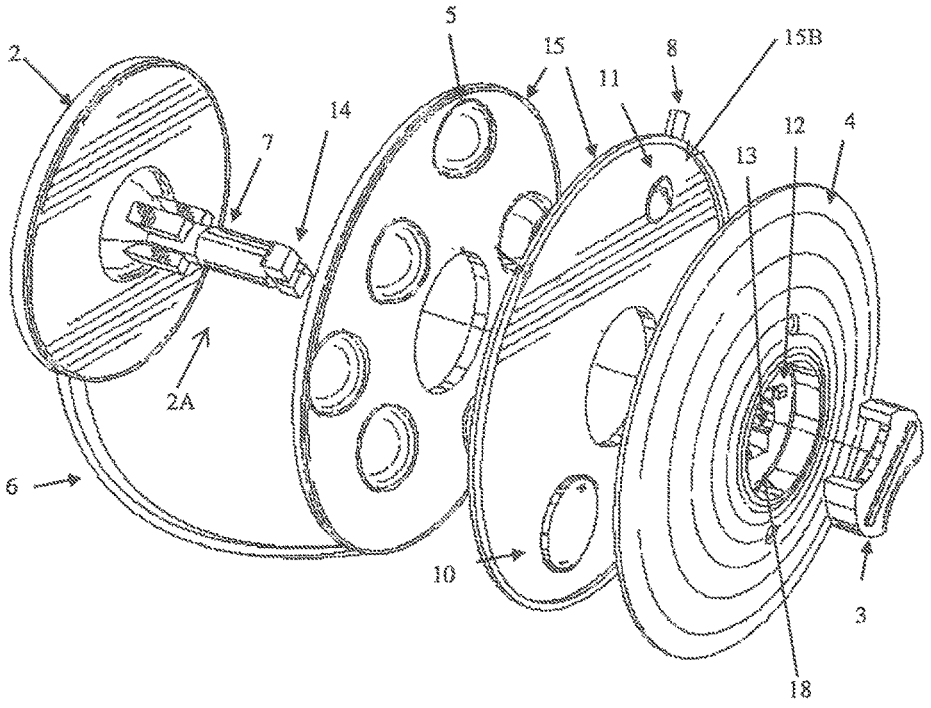
FIG. 2: is a front exploded view of the shoe lace securement mechanism with the spool, the threading piece with locking mechanism, the cap piece, and an ornamental casing.
Figure 3:
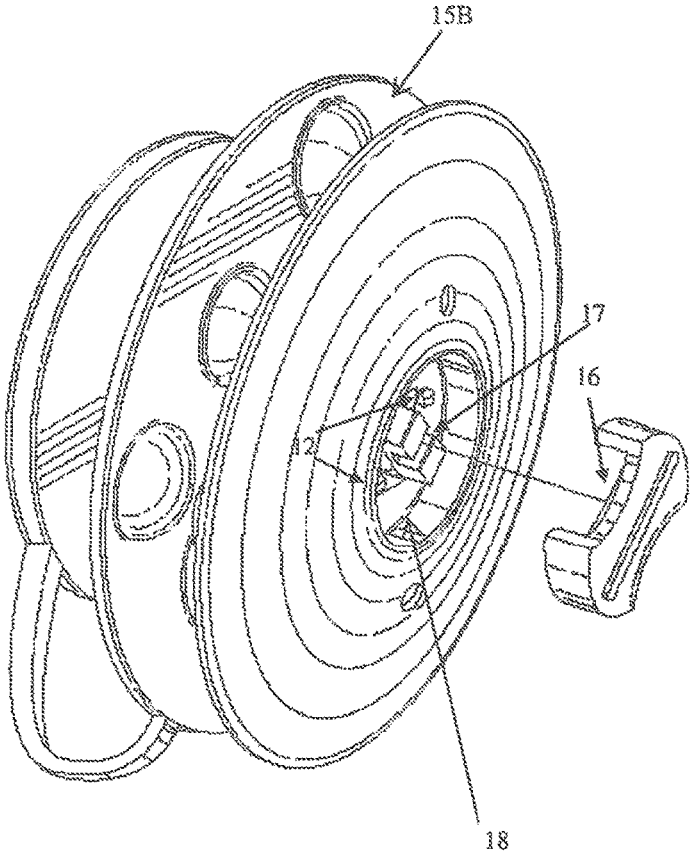
FIG. 3: is a perspective view of the shoe lace securement mechanism with the threading piece with locking mechanism inserted through the spool.

FIG. 1 depicts a side perspective view of the shoe lace securement mechanism with the spool 1, the threading piece with locking mechanism 2, and the cap piece 3, and an ornamental casing 4. All elements listed in a certain embodiment are modular and not specific to all embodiments of the present invention.

A certain embodiment of a lace securement mechanism includes a spool 1 comprised of two disc-shaped edges 15 connected via a centrally located hollow tube 9. The hollow tube 9 is configured to accept a central protrusion 7 from the threading piece 2 with locking mechanism 2A. The hollow tube 9 permits passage of the central protrusion 7 of the threading piece 2 only when properly aligned. A plurality of radially located protrusions 5 are interspersed equidistantly on the inward facing walls 15A of each disc shaped edge 15 of the spool 1. These protrusions 5 are of variable shape and are designed to increase the compressive force against the shoe lace as it is wrapped around the spool 1. Additionally, these protrusions 5 can be configured to have a rough exterior to increase friction with the shoe lace as torque is inadvertently applied to the shoe laces. Each protrusion 5 is aligned with its sister protrusion on the opposing inward facing wall 1A of the disc shaped edges 15 but leaves sufficient space to permit a shoe lace to penetrate to the hollow central tube of the spool 1 when sufficient force is manually applied by the user. The outward facing wall 15B disc-shaped edge 15 contains a circular depression and two vertical protrusions 12 in the center where the hollow tube 9 emerges to prevent the rotation of the cap piece 3 when affixed to the distal end 14 of the threading piece 2.

The threading piece with locking mechanism 2 is comprised of a disc shaped piece and a solid protrusion 7 extending perpendicular to the disc shaped piece. The solid protrusion 7 is configured to traverse the hollow tube of the spool 1 only when properly aligned. The distal end of the protrusion 14 provides for a locking mechanism whereby the protrusion 7 is shaped as a rectangle or other suitable shape with an indentation configured to receive a male insertion component from the cap piece 3. Once the distal end of the protrusion 14 emerged from the centrally located hollow tube of the spool 1, it can be rotated approximately ninety degrees to prevent the protrusion 7 from slipping back through the hollow tube 9. The threading piece 2 will be secured to the spool 1 via a flexible material that will run from the side facing wall of the disc shaped edge 15 closest to the shoe to the side wall of the threading piece. This strap 6 will prevent rotation of the device of more than one rotation by physical contact with the shoe lace.

The cap piece 3 is comprised of configured shape to fit in the depression 18 on the outward facing wall 15B of the spool 1 such as the ovular shaped piece with crescent indentations to be placed on top of the distal end of the protrusion 14 when it has traversed the hollow tube of the spool 1. A centrally located male insertion piece 16 rises from the inward facing wall of the cap piece 3 fits into a female receptor 17 of the distal end of the protrusion. Once mated, any torque applied to the threading piece 2 will be transferred to the cap piece 3 which prevents rotation by contact with two vertical protrusions 12 on the outward facing disc-shaped circular depression. The cap piece 3 may be secured to the spool 1 via a flexible material that will run from the outer facing wall of the disc shaped edge closest to the shoe.

The ornamental casing 4 will be affixed to the outer facing wall of the spool 1 with a central depression to permit the cap piece to mate with the distal end of the protrusion. The ornamental casing will be comprised of a translucent plastic and will contain a plurality of light-emitting diodes 11 ("LED") and a power source 10. The plurality of LEDs 11 can be variably configured to illuminate a logo, character, number, symbol, or image affixed to the surface of the ornamental casing as required. Additionally or alternatively, the plurality of LEDs 11 can be illuminated in different colors or at varying intervals. The LEDs can be activated by a switch 8 or other common activation method located on the ornamental casing 4.

A present and primary embodiment envisions usage by placing the threading piece 2A with locking mechanism 2 on the inside of a shoe 19 at the highest located aperture configured to receive a shoe lace. The spool 1 is placed on the opposing side of the same aperture. The threading piece 2 is fed through the aperture of the shoe 19 and the spool 1. The threading piece 2 is then rotated ninety degrees. The cap piece 3 is then placed on the distal end of the protrusion 7. The same process is repeated on the opposite side of the shoe 19 with a second device.

A user will then manually tighten the shoe laces to the desired tension level. At the desired tension level, a user will align the shoe lace with the spool 1 and begin to wrap the shoe laces around the spool 1 in a circular motion. The surface friction of the laces on the spool 1 will prevent any loss of tension in the shoe lace. Additionally, the radially dispersed protrusions 5 on the inner facing walls of the spool 1 will add additional friction by keeping the shoe lace compressed around the spool.

A certain embodiment of a lace securement mechanism can be incorporated into the design and manufacturing of a shoe. The lace securement mechanism will be placed by a manufacturer at the highest aperture on the wall of a shoe on each side of a shoe. The lace securement mechanism, instead of placing a removable cap 3 on the protrusion 7 of the threading piece 2, the threading piece can be integrated into the side wall of a shoe via sewing or molding techniques commonly known in the art. As a result of this integration, no flexible material that will run from the side facing wall of the disc shaped edge closest to the shoe to the side wall of the threading piece is needed.

This embodiment of a lace securement mechanism includes a hollow tube comprised of flexible material affixed to the rear of the shoe heel, extending the circumference of a shoe's heel, vertically aligned with the lace securement mechanism. A securing clasp is affixed to the heel of the shoe laterally located to the lace securement mechanism. The securing clasp is comprised of a receiving aperture designed to receive the head of a shoe lace located closest to the lace securement mechanism and an integrated aperture which has been configured to receive an elastic band. The elastic band runs through the hollow tube and maintains the desired level of tension in the shoe lace by applying pull force to each shoe lace head via the securing clasp.

In view of the foregoing discussion, it may be readily understood that alternative embodiments are contemplated. Having thus described different embodiments of the invention, other variations and embodiments that do not depart from the spirit of the invention will become readily apparent to those skilled in the art. The scope of the present invention is thus not limited to any one particular embodiment, but is instead set forth in the appended claims and the legal equivalents thereof.

I claim:

1. A shoe lace securement mechanism comprising:

a spool having a pair of circular discs connected together, wherein the pair of circular disks includes opposing inward facing walls having a plurality of protrusions to add friction for keeping a shoe lace compressed around the spool, wherein a first group of protrusions of the plurality of protrusions on a first circular disc of the pair of circular discs align with a second group of protrusions of the plurality of protrusions on a second circular disk of the pair of circular disks;

a hollow tube centrally located on the pair of circular discs, the hollow tube connecting the pair of circular discs and providing for a space between the opposing inward facing walls of the pair of circular disks;

a threading piece with locking mechanism configured for threading and locking the spool, the threading piece with locking mechanism comprising an additional disc and a solid protrusion extending from a central area of the additional disc, the solid protrusion traversing an inside of the hollow tube such that a distal end of the solid protrusion emerges from the hollow tube, the solid protrusion being configured to lock in place by rotation of the distal end to prevent the solid protrusion from slipping back through the hollow tube;

a casing affixed to an outer facing wall of the second circular disk, a central depression formed in an outer facing surface of the casing;

a cap piece positioned in the central depression and mating with the distal end of the solid protrusion;

a pair of vertical protrusions formed in the central depression, the pair of vertical protrusions in the central depression preventing rotation of the cap piece; and a strap extending from the additional disc to the second circular disc of the pair of circular discs of the spool.

2. The shoe lace securement mechanism of claim 1, wherein the spool houses a plurality of light-emitting diodes, a power source, and a switch.

* * * * *